US005384928A

United States Patent [19]

Khoury

[11] Patent Number: 5,384,928

[45] Date of Patent: Jan. 31, 1995

[54] SUBMERGED SURFACE CLEANER

[75] Inventor: Edward J. Khoury, Brackenhurst, South Africa

[73] Assignee: Swimline Holdings Limited, Johannesburg, South Africa

[21] Appl. No.: 205,877

[22] Filed: Mar. 3, 1994

[30] Foreign Application Priority Data

Mar. 4, 1993 [ZA] South Africa ..... 931530

[51] Int. Cl.[6] ..... E04H 3/20

[52] U.S. Cl. ..... 15/1.7; 137/624.14; 137/854

[58] Field of Search ..... 15/1.7; 137/624.14, 137/854

[56] References Cited

U.S. PATENT DOCUMENTS 4,742,593 5/1988 Kallenbach ..... 15/1.7
4,769,867 9/1988 Stoltz ..... 15/1.7

FOREIGN PATENT DOCUMENTS 2172195 9/1986 United Kingdom ..... 15/1.7

*Primary Examiner*—Edward L. Roberts
*Attorney, Agent, or Firm*—Barnes & Thornburg

[57] ABSTRACT

A valve member which is suitable for use in a fluid control valve in a swimming pool cleaner, which is made from a resiliently deformable material and which has a tubular core with a fastening formation near one end and a substantially mushroom-shaped annular flexible component at an opposed end.

2 Claims, 1 Drawing Sheet

SUBMERGED SURFACE CLEANER

BACKGROUND OF THE INVENTION

This invention relates generally to a valve and more particularly to a device for cleaning a submerged surface.

A plurality of devices for cleaning submerged surfaces are described in the prior art. Such devices are exemplified for example in the specifications of South African patents Nos.87/6572, 84/10036, 77/7426, 83/1155, 86/3403, 75/1166, 78/5946, 78/5947, 76/6618 and 88/2544.

It is apparent from the prior art that many approaches have been relied on in providing cleaning devices of the kind referred to. There is a perceived demand or requirement for a valve, which is suitable for use in a cleaning device of the kind described, which is of simple construction, reliable and with a long life.

SUMMARY OF THE INVENTION

The invention provides a valve which includes a body in which is formed a passage, the passage having an inlet and an outlet, and a valve member which is located in the passage between the inlet and the outlet, the valve member including a flexible element which is spaced from an inner wall of the passage to define an aperture for fluid flow, the flexible element being movable towards or away from the said wall to vary the size of the aperture.

The flexible element may take on any suitable form. The flexible element may for example comprise an annular component which may be movable, substantially along its entire periphery, towards and away from the said wall.

In one example of the invention the valve member is located substantially concentrically inside the passage to define an annular aperture around the flexible element.

The invention also extends to a device for cleaning a submerged surface which includes the aforementioned valve, a mouth which is defined by the said body and which is adapted to be brought into suction communication with the surface which is to be cleaned, and wherein the passage is inclined to the said surface. The passage may be inclined at any suitable angle which may for example lie between 30° and 60° relatively to the surface.

The outlet of the passage may be adapted to be connected via a flexible hose or conduit to a suction source.

The said mouth may be surrounded by a skirt, which may be flexible, which is adapted to lie in scraping contact with the surface which is to be cleaned.

The invention also extends to a valve member which includes a core which is at least partially surrounded by a flexible element which is spaced from the core. The core and the element may be integrally formed. The core and the element may be formed from a resiliently deformable material such as a plastics or rubber material. The core is preferably tubular.

The core may be adapted to be secured to a mounting component.

A valve member of the kind referred to may be incorporated in the valve or in the cleaning device which has been referred to hereinbefore.

The invention also extends to a method of operating a cleaning device which includes the steps of directing fluid flow through an annular aperture which is defined in the cleaning device and of varying the size of the annular aperture thereby to vary the rate of fluid flow through the aperture in a manner which causes movement of the cleaning device over a submerged surface which is to be cleaned.

The size of the annular aperture may be varied by allowing or causing the fluid flow through the aperture to move at least a portion of a valve member which defines at least part of the annular aperture.

BRIEF DESCRIPTION OF THE DRAWINGS

The invention is further described by way of example with reference to the accompanying drawings in which.

DESCRIPTION OF PREFERRED EMBODIMENT

Figures 1, 2:
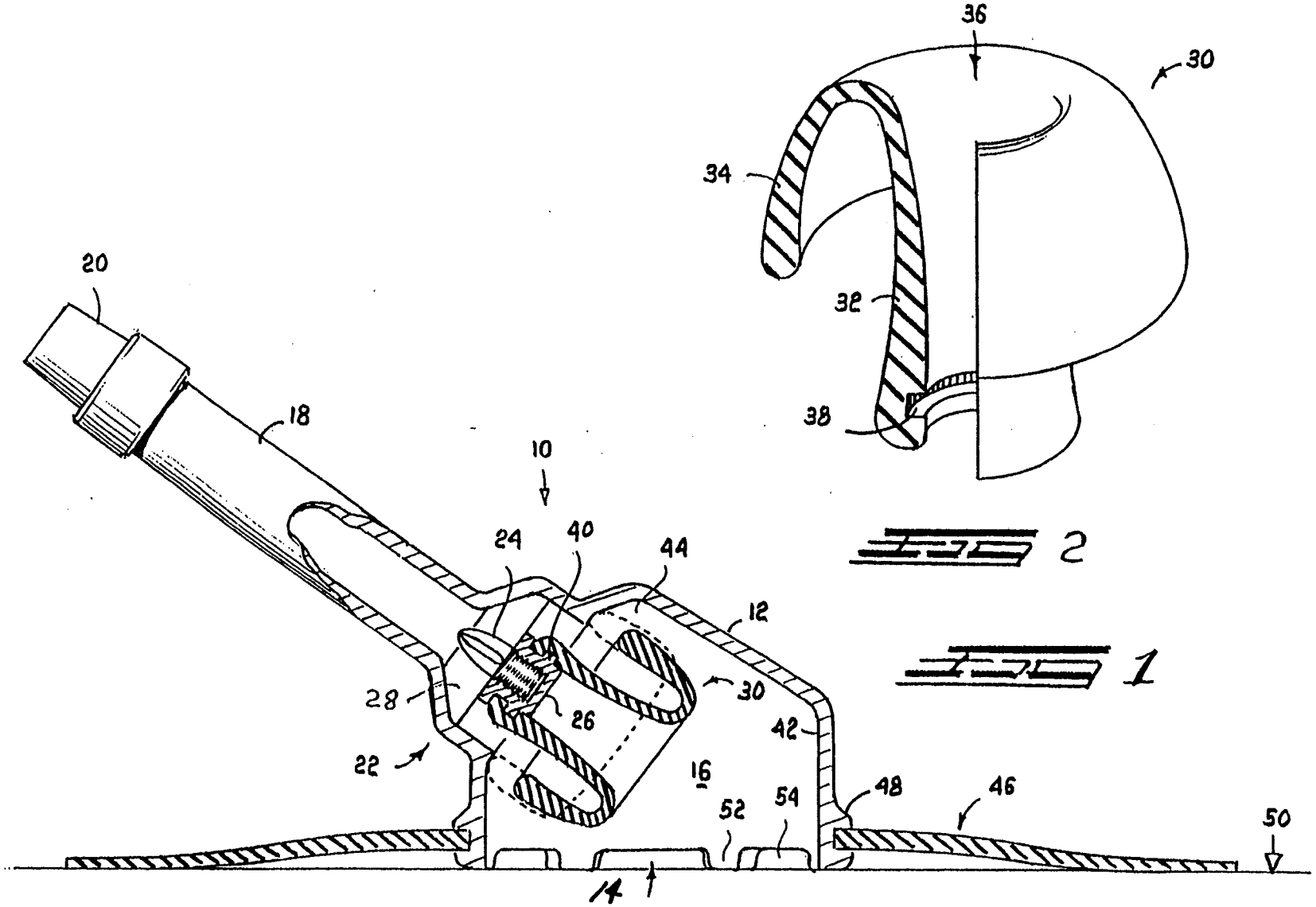
FIG. 1 is a side view partly sectioned of a device for cleaning a submerged surface according to one form of the invention.
FIG. 2 illustrates in perspective and partly sectioned a valve member for use in the cleaning device shown in FIG. 1.

FIG. 1 of the accompanying drawings illustrates a device 10 for cleaning a submerged surface such as a submerged surface of a swimming pool.

The device includes a body 12 which is moulded from a suitable plastics material and which is formed with a mouth 14, a chamber 16, and a conduit 18.

The conduit 18 and the chamber define a passage to which the mouth 14 forms an inlet. The conduit 18 has a spigot 20 which may be rotatable about its axis, which defines an outlet and which is adapted to be connected to a flexible suction hose, not shown. The housing 10 is connected in a known manner to the suction side of a swimming pool filtration system so that water which is drawn through the conduit is circulated in a known manner through a filtration system in which entrained matter is removed, and then returned to the swimming pool in which the device 10 is located.

Located between the mouth 14 and the outlet 20 is a valve 22. The valve includes a mounting component 24 which consists of a central spigot 26 which is located at the centre of a number of fingers 28 which extend from an inner wall of the body 12 and which are spaced apart from one another to define apertures between them. These apertures therefore permit water in the swimming pool, when drawn along by the pump of the filtration system, to pass from the chamber through the apertures to the conduit 18.

Located on the component 24 is a valve member 30 which is made from a suitable resiliently deformable rubber material and which is shown in perspective and partly sectioned, and also in enlarged detail, in FIG. 2.

The valve member 30 includes a tubular core 32 and a spaced flexible circular surrounding element 34 which is formed integrally with the core at one end thereof. The valve member 30 thus has a mushroom shape except for a bore 36 which extends through the member and which is formed with an inner circular slot 38 which permits the core to be engaged with a rib 40 on the component 24, as is shown in FIG. 1.

With the valve member fixed to the body 12, in the manner described, the flexible element 34 which is spaced from an inner wall 42 of the body, defines an annular aperture 44 around the valve member.

A flexible rubber skiff 46 is engaged with a formation 48 on an outer surface of the body.

The cleaning device 10, once the spigot 20 has been connected to a flexible suction hose in the manner described, is placed in a swimming pool or other body of liquid which is to be cleaned so that the mouth 14 opposes a surface 50 which is to be cleaned. The skiff 46 rests on the surface.

The body 12 has downwardly extending projections 52 which effectively define inlet apertures 54 to the mouth 14 so that when suction is applied to the spigot 20 water can flow into the chamber 16.

Water which enters the chamber 16 is drawn through the annular aperture 44 around the flexible element 34 and into the conduit 18. As the water flows through the annular aperture it impinges on the valve member 30 and causes a slight movement of the element 34 towards the surrounding wall 42 of the body. The size of the aperture is thereby decreased and this causes an increase in the velocity of the water flowing through the aperture. The increase in velocity reduces the prevailing pressure in the aperture and as a consequence the element 34 is further deflected towards the wall 42.

As the element moves towards the wall the aperture 44 decreases in area and the velocity of the water increases, further decreasing the prevailing pressure. The flexible element thus deflects further until eventually the water flow through the aperture is completely stopped or substantially reduced. When this happens the prevailing pressure in the aperture increases and the flexible element returns to its undeformed position. The two positions i.e. the deformed and undeformed positions are shown in dotted and solid lines respectively in FIG. 1.

It is apparent from the preceding description that the flow of water through the chamber and to the conduit is repeatedly stopped, wholly or partially, and permitted without impediment. When the water flow through the conduit 18 is reduced substantially the suction pressure at the mouth 14 is also reduced and the body 12 adheres with a lower force to the surface which is being cleaned. The fluctuating water column flowing through the conduit causes reactive forces on the body 12 and on the flexible suction hose which is connected to the spigot 20. These forces are particularly pronounced as the suction pressure is reduced and as a consequence the device 10 moves in a random fashion over the surface 50 which is to be cleaned. The inclination of the conduit 18 relatively to the surface 50 lies at an angle of between 30° and 60°. This angle can be varied, according to experiment and trial, to a value which imparts an optimum type of movement to the device.

The only moving part in the cleaning device 10 is the valve member 30. The life of this member is determined inter alia by the frequency with which it deforms but, in essence, the deformation is a flexing to and fro of the element 34 relatively to the core 32. If the member 30 should fail, due to fatigue or for any other reason, then it is a relatively simple matter to install a new member 30.

A further advantage resides in the fact that the size of the aperture 44 is relatively large and the water which is drawn through the apertures 54 and circulated to the filtration system can carry entrained particles of relatively large size. If a twig or similar elongate object passes through the aperture 44 this will not normally, in itself, cause the valve member to become jammed for it will nonetheless flex at least to a limited extent between the solid and dotted line positions and, ultimately, any blockage or threatened blockage should be cleared.

If the aperture should be blocked then it is relatively simple to deform the valve member and in particular the element 34 and remove the cause of the blockage.

I claim:

1. A device for cleaning a submerged surface which includes a valve having a body in which is formed a passage, the passage having an inlet and an outlet, and a valve member which is located in the passage between the inlet and the outlet, the valve member including a flexible element which is spaced from an inner wall of the passage to define an aperture for fluid flow, the flexible element being movable towards or away from the said wall to vary the size of the aperture, the outlet of the passage being adapted to be connected via a flexible hose or conduit to a suction source, a mouth which is defined by the said body being adapted to be brought into suction communication with the surface which is to be cleaned, the passage being inclined at an angle of between 30° and 60° relatively to the surface.

2. A device according to claim 1 wherein the mouth is surrounded by a skirt which is adapted to lie in scraping contact with the surface which is to be cleaned.

* * * * *